United States Patent [19]

Stehlík

[11] 4,396,475

[45] Aug. 2, 1983

[54] PROCESS FOR CONTINUOUSLY REGENERATING FERRIC CHLORIDE SOLUTIONS

[75] Inventor: Antonín Stehlík, Rožnov pod Radhoštěm, Czechoslovakia

[73] Assignee: TESLA, Koncernovy podnik, Praha, Czechoslovakia

[21] Appl. No.: 315,477

[22] Filed: Oct. 27, 1981

[30] Foreign Application Priority Data

Oct. 30, 1980 [CS] Czechoslovakia ..... 7330-80

[51] Int. Cl.[3] ..... C25F 7/02

[52] U.S. Cl. ..... 204/130

[58] Field of Search ..... 204/130

[56] References Cited

U.S. PATENT DOCUMENTS

| | | | |
|---|---|---|---|
| 3,622,478 | 11/1971 | Beyer | 204/130 |
| 3,788,915 | 1/1974 | Gulla | 204/130 |
| 4,269,678 | 5/1981 | Faul et al. | 204/130 |

*Primary Examiner*—R. L. Andrews

*Attorney, Agent, or Firm*—Murray Schaffer

[57] ABSTRACT

The continuous electrolytic regeneration of ferric chloride solutions used for etching metals is effected by transferring the partially exhausted solution to the anodic space of an electrolyzer where it is exposed to direct current. The etched metal is deposited on the cathode, and the $Fe^{2+}$ is oxidized to $Fe^{3+}$ in the anodic space. The latter is separated from the cathodic space through a diaphragm and the regenerated solution is recirculated to the etching bath.

7 Claims, 1 Drawing Figure

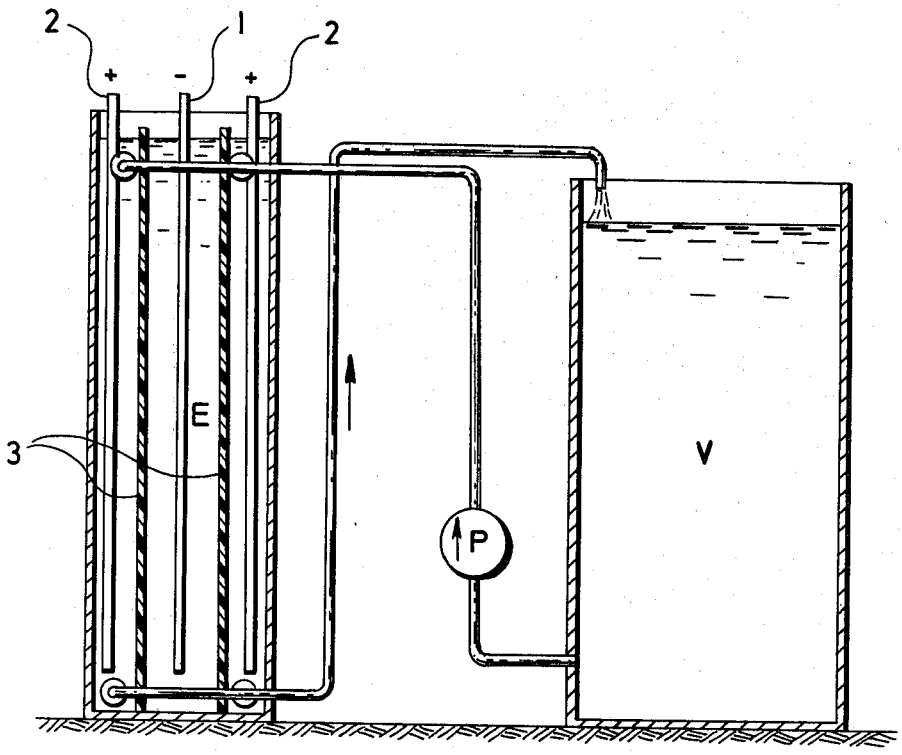
2
1
2
+
-
+
E
3
P
V

PROCESS FOR CONTINUOUSLY REGENERATING FERRIC CHLORIDE SOLUTIONS

BACKGROUND OF THE INVENTION

The invention relates to a process of continuous electrolytic regeneration of aqueous ferric chloride solutions.

It is known that for etching fine structures in metal foils, ferric chloride solutions are used. The etching process is based upon the reaction $$2Fe^{3+}+Fe \rightarrow 3Fe^{2+} \quad (1)$$

or $$2Fe^{3+}+Cu \rightarrow Cu^{2+}+2Fe^{2+} \quad (2)$$

In such an etching process, the ferric chloride solution becomes exhausted and results in a corresponding decrease in the etching speed; so that when the $Fe^{3+}/Fe^{2+}$ ratio has reached a value of less than 3, it is necessary to either exchange the etching solution or regenerate it. There exists a known method of regeneration through the addition of chlorine to the solution which corresponds to the equation $$Fe^{2+}+\tfrac{1}{2}Cl_2 \rightarrow Fe^{3+}+Cl^- \quad (3)$$

In such a process, the continuous addition of chlorine concentration gradually increases the iron chloride concentration so that the solution has to be diluted. The remittant excessive volume of the etching solution must be let out of the etching bath.

Among the disadvantages of the aforementioned process is the need for expensive safety precautions, in view of the chlorine manipulation, transport and storage, and the fact that the amount of etched-off iron gives rise to about a 7-times weight of iron chloride solution which constitutes a waste which is difficult to dispose of.

It is an object of the present invention to eliminate the drawbacks of the prior art as hereinabove referred to and to provide an improved process of continuous regeneration of ferric chloride solution.

DESCRIPTION OF THE INVENTION

The process, according to the invention, consists of transferring at least a portion of the ferric chloride solution after having been partially exhausted by etching a metal from the etching bath to the anodic space of an electrolyzer where it is exposed to direct current at a temperature of from 50° to 95° C. By maintaining a current density of from 0.2 to 0.6 A/cm$^2$, the etched metal is deposited on the cathode of the electrolyzer and $Fe^{2+}$ is oxidized to $Fe^{3+}$ in the separated anodic space. The thus regenerated etching solution may then be circulated back into the etching bath.

Following reactions exist on the cathode of the electrolyzer:

$$Fe^{3+}+3e \rightarrow Fe \quad (4)$$

or $$Cu^{2+}+2e \rightarrow Cu \quad (5)$$

$Fe^{2+}$ is oxidized to $Fe^{3+}$ in the anodic space of the electrolyzer according to the equations:

$$Cl^- - e \rightarrow \tfrac{1}{2}Cl_2 \quad (6)$$

$$\tfrac{1}{2}Cl_2+Fe^{2+} \rightarrow Fe^{3+}+Cl^- \quad (7)$$

The anodic space of the electrolyzer is separated from the cathodic space thereof by means of a diaphragm which allows a diffusion of ions of the metal being deposited on the cathode and prevents the anode space contents from being mixed with the cathode space contents.

The intensity of direct current flowing through the electrolyzer is preferably maintained on a level such that the amount of metal deposited on the cathode per unit time is substantially equal to the metal supplied into the ferric chloride solution due to the etching process in the etching bath.

The temperature of the solution to be regenerated in the electrolyzer is maintained within the range of from 50° to 95° C. by controlling the speed of recirculation of the solution between the electrolyzer and the etching bath of a temperature within 40° to 70° C.

Preferably, the regeneration is to be carried out at a higher temperature than that of the etching bath. In this way, it is made possible to employ the heat liberated in the electrolyzer for heating the etching bath.

The process according to the present invention enables that etching solution of ferric chloride to be regenerated while maintaining its volume and composition. The cost to be expended on the electric power for the electrolytic regeneration is lower than the price of chloride necessary therefor. This regeneration process furthermore does not give rise to unwanted technological waste and the end product is pure reusable metal. The heat liberated in the electrolyzer can be used for the necessary heating of the etching bath. Still further, the process eliminates the risk of destruction of the plant, as a result of which expensive safety and hygienic precautions need not be undertaken.

BRIEF DESCRIPTION OF THE DRAWINGS

FIG. 1 is a schematic drawing depicting the apparatus and the manner of operation of the process of this invention.

DESCRIPTION OF THE INVENTION

The apparatus as shown in FIG. 1 comprises an etching tank V, an electrolyzer E, a cathode 1, and an anode 2 and a diaphragm 3 separating the electrolyzer into anode and cathode spaces. In operation, an exhausted etching solution is supplied from the etching tank V into the electrolyzer E through suitable conduits, valves and pumps. By application of direct current to the electrodes, the etched metal is deposited on the cathode 1 while the etching solution is regenerated in the space of the anode 2. The diaphragm 3 is a suitable ion exchange membrane designed for limiting the intermixing of the cathode space contents with the anode space contents. The regenerated solution is then circulated back from the anodic space to the etching tank again by suitable conduit, valves and pumps.

The following examples are given as illustrative only without, however, limiting the invention to the specific details thereof.

EXAMPLE 1

250 milliliters of a ferric chloride solution, which has been partially exhausted by etching apertures to form an iron foil, comprising 290 g $FeCl_3$ and 92 g $FeCl_2$ per liter was transferred from the tank V to the electrolyzer E for electrolytic regeneration.

An iron cathode, a graphite anode and a fibre glass fabric diaphragm is employed in the electrolyzer E. After one hour of electrolytic regeneration by direct current having the intensity of 4 A, at the temperature of 90° C. and current density of 0.24A/cm$^2$, there was a deposit of 2.446 g Fe on the cathode, which corresponded to 88 percent cathode current yield. In this way, the $Fe^{3+}/Fe^{2+}$ ratio rose from the original value of 2.46 to 10.7.

EXAMPLE 2

A ferric chloride solution which after having been exhausted by etching to form a copper foil comprised 260 g $FeCl_3$+129 g $FeCl_2$+69 g $CuCl_2$ per liter, was subjected to continuous electrolytic regeneration in the electrolyzer E buy 10A direct current at 50° C. (copper cathode, graphite anode, fibre glass fabric diaphgram were used). The solution to be regenerated passed through the anodic space of the electrolyzer at the throughflow speed of 7 ml per minute. Within an hour, there was deposited on the cathode an 11.5 g copper deposit, which corresponded to a 97 percent current yield. The $Fe^{3+}/Fe^{2+}$ ratio in the regenerated solution rose from the original value of 1.56 to 14.2.

EXAMPLE 3

A ferric chloride etching bath having the constant composition of 300 g $FeCl_3$ and 100 $FeCl_2$ per liter, was used to dissolve iron in the production of a masked iron foil in the thickness of 0.15 mm at the temperature of 70° C. and at the speed of 30 g of Fe per hour. The bath was circulated at the speed of 7 liters per hour through the anodic space of the electrolyzer E, which had an iron plate cathode 1 and a graphite anode 2, separated from each other by the diaphragm 3 of fibre glass fabric; and in which the following parameters were observed:

| | |
|---|---|
| cathode surface | 160 cm$^2$ |
| anode surface | about 320 cm$^2$ |
| distance between the electrodes | 30 mm |
| current | 48 A |
| cathode current density | 0,3 A/cm$^2$ |

The electrolyzer is made from polypropylene. Construction material of the circulation pump is polypropylen and titan. The foil etching process and the electrolytic regeneration of the etching bath were conducted simultaneously. On the cathode, there was deposited, on an average, 30 g Fe per hour, which according to the Faraday law corresponded to a 90 percent cathode current yield. Total content of iron was determined areometrically, the content of $Fe^{2+}$ was determined manganometrically. The $Fe^{3+}/Fe^{2+}$ ratio in the etching bath remained constant.

The method of ferric chloride solution regeneration according to the invention can be preferably availed of, for instance, in the process of manufacturing iron masks for colour picture cathode say and the like tubes.

What is claimed is:

1. A process for continuously regenerating a partial exhausted ferric chloride solution used for the bath of etching metals comprising the steps of providing an electrolyzer separated into a vertical anode space and a vertical cathode space by an ion exchange diaphragm, locating an anode extending freely into said anode space and a cathode extending freely into said cathode space and simultaneously feeding at least a part of said exhausted solution from the etching bath to the top of said anode space exposing said exhausted solution to direct current between the anode and cathode at a temperature and at a current density for a time sufficient to permit the deposition of metal on the cathode and the oxidation of the $Fe^{2+}$ to $Fe^{3+}$ in the anode space, and withdrawing regenerated solution from the bottom of said anode space for return to said etching bath, the circulation of said solution being maintained at a rate such that no free chlorine is liberated from said solution.

2. The process as claimed in claim 1 wherein the electrolyzer tank is divided into three compartments by two diaphragms so located as to limit the mixing of the anode solution with the cathode solution and to permit an intensive flow of the regenerated etching solution in the compartments between the diaphragms and the anodes.

3. A process as claimed in claim 1 including the step of circulating said solution and maintaining the density of the direct current at a level, such that the deposition on the cathode per unit time is substantially equal to the amount of metal supplied to the etching bath due to the etching process.

4. A process as claimed in claim 3 including the step of maintaining the temperature of the solution to be regenerated by controlling the speed of recirculation of the solution between the electrolyzer and the etching bath.

5. A process as claimed in claim 4, wherein the speed of circulation of the solution through the electrolyzer is regulated so that the temperature within the electrolyzer is maintained higher than the desired temperature of the etching bath and the heat energy in the electrolyzer is used for heating of the etching bath.

6. The process as claimed in claim 1 wherein the direct current intensity is so controlled that the ratio of $Fe^{3+}/Fe^{2+}$ in the etching bath may be kept at a constant value.

7. The process as claimed in claim 1 whereing the current between anode and cathode is maintained at a density of from 20 to 60 A/dm$^2$ at a temperature of from 50° to 95° C.

* * * * *